United States Patent [19]

Baldwin

[11] 4,349,171

[45] Sep. 14, 1982

[54] SHELF MOUNTING BRACKET FOR STORAGE RACK

[75] Inventor: Mark H. Baldwin, Cincinnati, Ohio

[73] Assignee: Nestier Corporation, Cincinnati, Ohio

[21] Appl. No.: 189,189

[22] Filed: Sep. 22, 1980

[51] Int. Cl.[3] ..... A47G 29/02

[52] U.S. Cl. ..... 248/243; 108/109; 211/187; 248/248; 403/187; 403/408

[58] Field of Search ..... 248/247, 300, 301, 250, 248/225.2, 163, 243, 248; 211/151, 191, 192, 135, 87, 187, 190; 403/254, 253, 187, 262; 408; 108/111, 107, 109

[56] References Cited

U.S. PATENT DOCUMENTS

| | | | |
|---|---|---|---|
| 2,026,223 | 12/1935 | Donnelly et al. | 211/135 X |
| 2,820,551 | 1/1958 | Mount | 108/107 |
| 2,925,920 | 2/1960 | Skubic | 108/107 |
| 4,142,638 | 3/1979 | Vargo | 211/187 |

FOREIGN PATENT DOCUMENTS

| | | | |
|---|---|---|---|
| 698874 | 10/1940 | Fed. Rep. of Germany | 403/408 |
| 1195961 | 11/1959 | France | 108/109 |

*Primary Examiner*—Ramon S. Britts
*Assistant Examiner*—Ramon O. Ramirez

[57] ABSTRACT

A shelf mounting bracket includes a flat rectangular plate having top and bottom edges, and opposite side edges. Integral flanges extend from the side edges perpendicular to the plate and upwardly opening shelf support hooks are formed at the bottom end portions of the flanges. A pair of elongated slots is provided in the plate intermediate the top and bottom edges thereof. The slots are spaced-apart from one another and are elongated in a direction extending across the plate side edges. The slots are alignable with holes in a vertical column of a storage rack having a column front face against which the plate is positioned with the flanges extending along side faces of the column. Holes in the column are aligned with the slots and a U-shaped bolt has its threaded legs extending through the column holes and plate slots. Nuts received on the threaded legs hold the plate against the column.

5 Claims, 7 Drawing Figures

SHELF MOUNTING BRACKET FOR STORAGE RACK

BACKGROUND OF THE INVENTION

This application relates to the art of brackets and, more particularly, to brackets for mounting shelves on vertical columns. The invention is particularly applicable for mounting downwardly inclined shelves in a gravity flow rack of an order picking system and will be described with particular reference thereto. However, it will be appreciated that the invention has broader aspects and can be used for mounting other shelves or the like.

Gravity flow racks used in order picking systems have generally rectangular shelves which are downwardly inclined from back-to-front. Merchandise positioned on the shelves adjacent the back thereof moves under the influence of gravity toward the shelf front. The shelves are supported on framework of various types supplied by many different manufacturers. The framing which can be used for supporting the shelves is often manufactured for other purposes and it is sometimes difficult to properly support downwardly inclined shelves thereon. It would be desirable to have a convenient arrangement for mounting downwardly inclined shelves on framing members.

SUMMARY OF THE INVENTION

Shelves are supported on metal framing members by the use of a shelf mounting bracket which includes a flat rectangular plate having top and bottom edges, and opposite side edges. Integral flanges extend from the plate side edges generally perpendicular to the plate. The bottom end portions of the flanges are formed into upwardly opening shelf support hooks having hook saddles extending generally perpendicular to the plate.

In a preferred arrangement, the plate has a pair of spaced-apart elongated slots therein intermediate the plate top and bottom edges. The slots are spaced-apart from one another and are elongated in a direction extending across the plate side edges.

The flanges have flange top ends spaced below the plate top edge, and the shelf support hooks are spaced above the plate bottom edge.

The bracket is secured to a generally vertical column having a front face against which the plate is positioned, with the flanges extending closely along opposite side column faces. Holes in the front face of the column are aligned with the plate slots for receiving a generally U-shaped bolt having threaded legs extending through the holes and slots. Nuts received on the threaded legs firmly hold the plate against the column front face.

It is a principal object of the present invention to provide an improved shelf mounting bracket.

It is also an object of the invention to provide an improved shelf mounting bracket which can be used with vertical framing members having holes therein.

DESCRIPTION OF A PREFERRED EMBODIMENT

Figure 1:
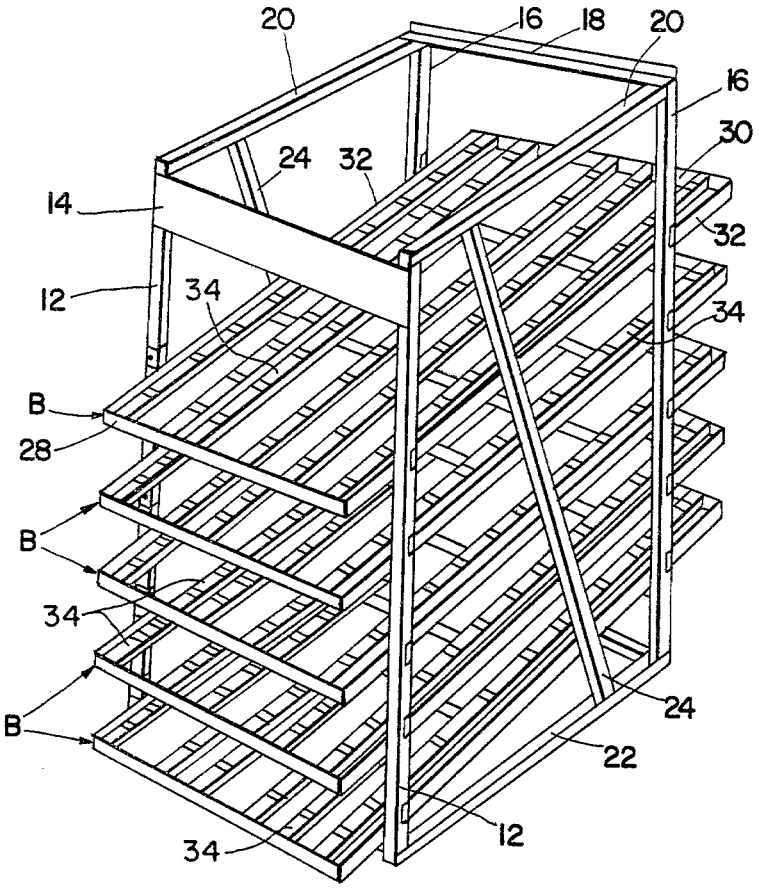
FIG. 1 is a diagrammatic perspective illustration of a gravity flow rack for use in an order picking system.

With reference to the drawing, FIG. 1 shows a generally cubical frame including spaced-apart vertical front columns 12 connected adjacent their upper ends by an upper front connecting member 14, and a pair of spaced-apart vertical rear columns 16 connected adjacent their upper ends by a rear connecting member 18. Upper side connecting members 20 and lower side connecting members 22 extend between the upper and lower ends of front and rear columns 12, 16. Diagonal connecting members 24 extend between the upper and lower side connecting members 20, 22.

A plurality of vertically-spaced shelves B are supported on columns 12, 16, and each shelf includes front and rear rails 28, 30 and opposite shelf side frame members 32. A plurality of track members 34 extend across shelf front and rear rails 28, 30 for supporting cartons of merchandise or the like and allowing such cartons to slide therealong. Each shelf B is supported in a position so that track members 34 are downwardly inclined from back rail 30 toward front rail 28. Merchandise cartons placed on track members 34 adjacent rear rail 30 move down toward front rail 28 under the influence of gravity.

Figure 2:
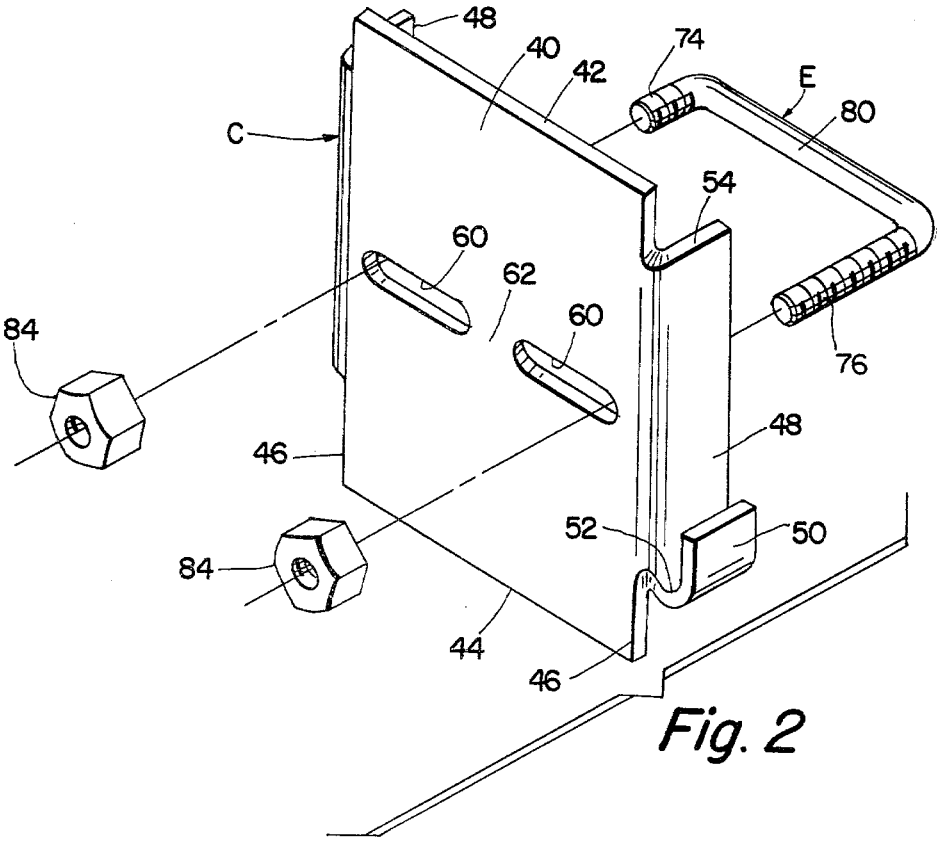
FIG. 2 is a perspective illustration of the improved shelf mounting bracket of the present application.

FIG. 2 shows a shelf support bracket C including a substantially flat rectangular plate 40 having top and bottom edges 42, 44 and opposite side edges 46. Integral flanges 48 are bent from side edges 46 and extend generally perpendicular to flat plate 40. Each flange 48 has its bottom portion formed into an upwardly opening shelf support hook 50 having a concave hook saddle 52 whose axis extends perpendicular to flat plate 40. Hook 50 and saddle 52 thereof is spaced above plate bottom edge 44. Each flange 48 has a flange upper end 54 spaced below plate top edge 42. Spacing flange top ends 54 below plate top edge 42 allows formation of successive brackets in a strip of metal without significant metal waste by providing excess metal at the bottom ends of the flanges to form hooks 50. The length of each flange 48, from flange top end 54 to hook saddle 52, is less than the length of a side edge 46 between top and bottom edges 42, 44 but is substantially greater than one-half the length of each side edge 46.

Plate 40 has a pair of elongated slots 60 formed therein approximately midway between top and bottom edges 42, 44. Slots 60 are spaced-apart from one another and are elongated in a direction extending across plate side edges 46 parallel to plate top and bottom edges 42, 44. Slots 60 occupy substantially greater than one-half of the distance across plate side edges 46 and are separated from one another by a solid plate portion 62 having a width between slots 60 which is substantially less than the length of each slot 60.

FIGS. 3–7 show tubular front colun 12 of rectangular cross-sectional configuration, and having a flat front face 66 and opposite flat side faces 68. At least front face 66 has vertically-spaced pairs of holes 70 therein.

Shelf mounting bracket C is positioned with flat plate 40 thereof engaging column front face 66, and with opposite flanges 48 extending closely adjacent column side faces 68. Slots 60 are alignable with column holes 70, and the elevation of a bracket C may be adjusted by aligning slots 60 with different vertical holes 70.

Figure 3:
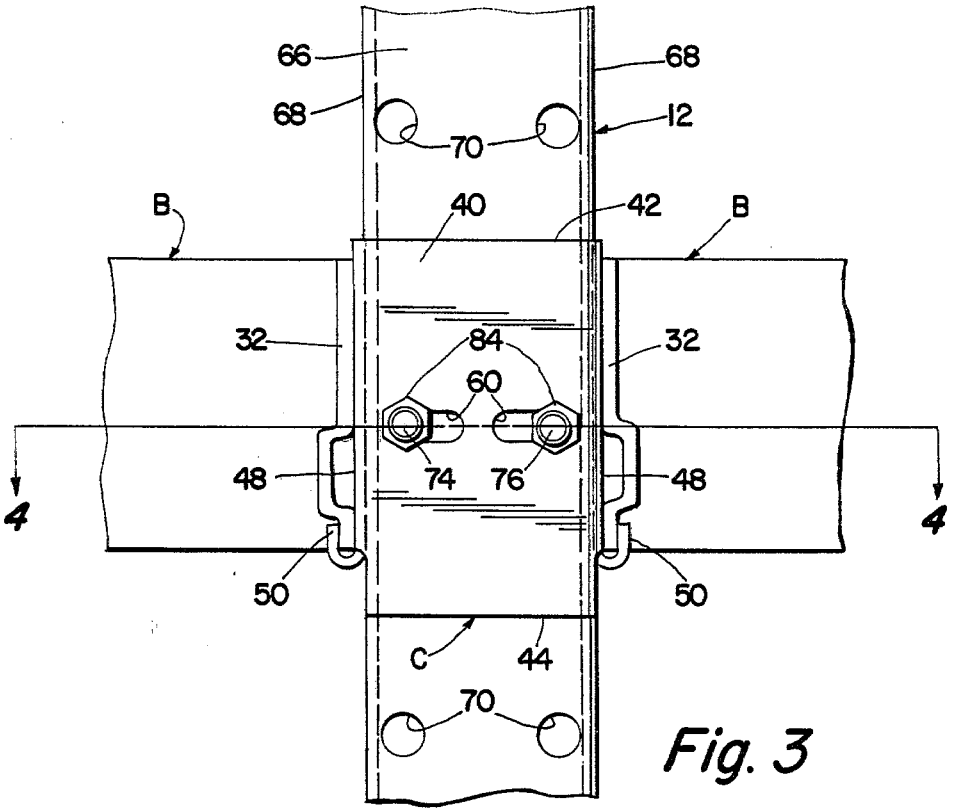
FIG. 3 is a front elevational view of a column having the shelf bracket mounted thereon.
Figure 4:
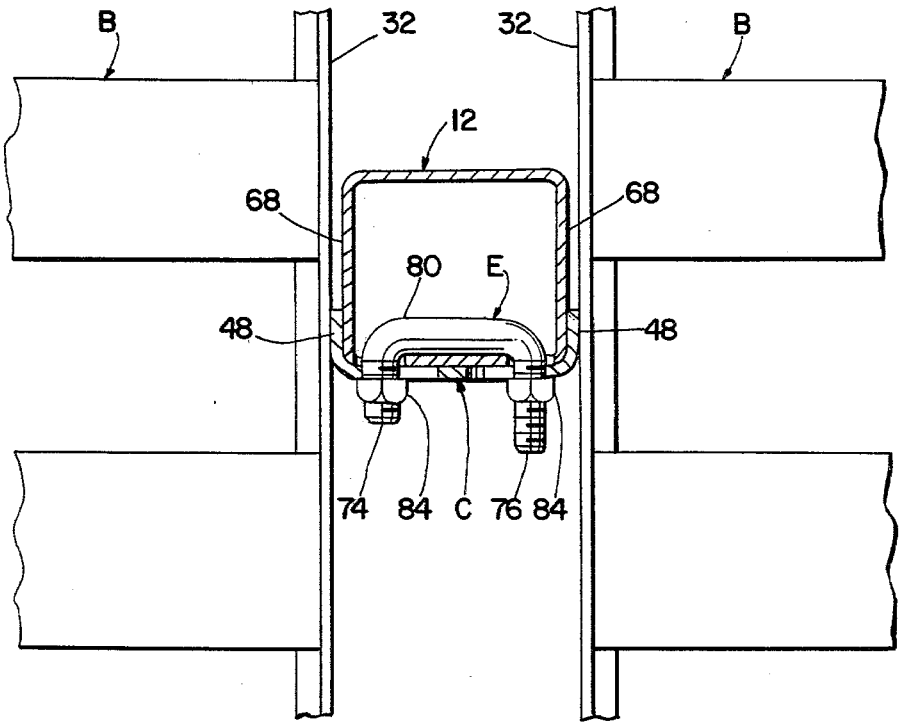
FIG. 4 is a cross-sectional plan view taken generally on line 4—4 of FIG. 3.
Figure 5:
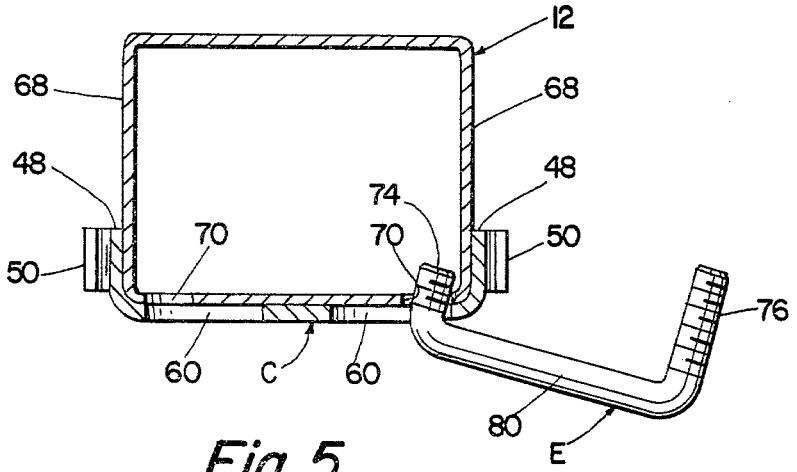
FIGS. 5–7 are cross-sectional plan illustrations showing sequential installation of a U-bolt for securing a shelf mounting bracket to a vertical column.
Figure 6:
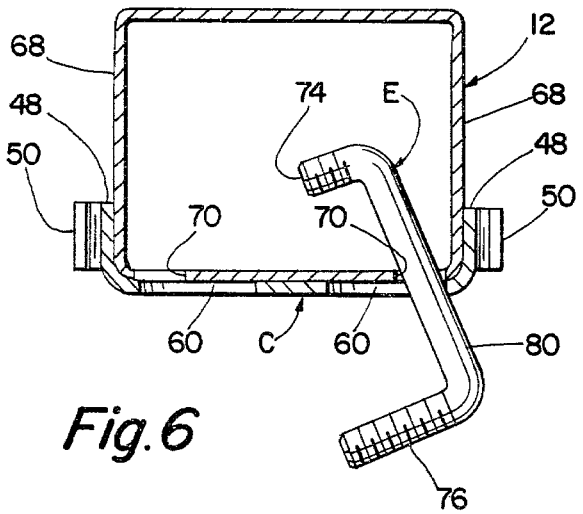
Figure 7:
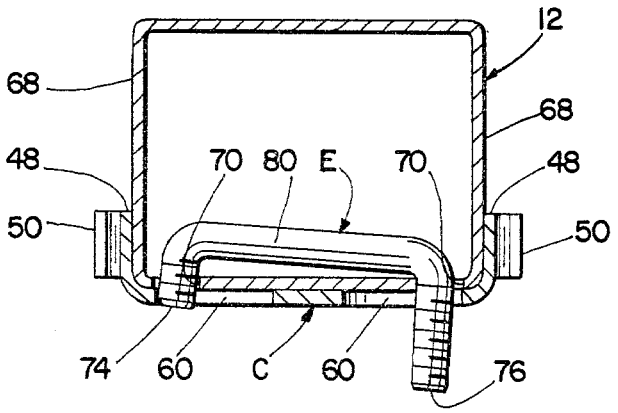

Bracket C is secured to a column by a U-bolt E having a short threaded leg 74 and a long parallel threaded leg 76 connected by a straight connecting portion 80. The diameter of the rod from which U-bolt E is made is smaller than the diameter of holes 70 and the smallest dimension of slots 60. For example, where U-bolt E is made from ⅜" diameter rod, the diameter of holes 70 and the smallest dimension of slots 60 is approximately ½". With a bracket C positioned against a column as described, long leg 76 of U-bolt E is grasped between a person's thumb and fingers. Short leg 74 is then inserted through a slot 60 and a hole 70. U-bolt E is then turned and manipulated for passing connecting portion 80 thereof through the first aligned slot and hole until short leg 74 is generally aligned with the other slot and hole inside of the column. The U-bolt is then pulled for passing short leg 74 through the opposite slot and hole in a direction from the inside of the column toward the outside thereof. One nut 84 is then threaded onto short leg 74 while long leg 76 remains held. Another nut 84 is subsequently threaded on leg 76. Nuts 84 are tightened for securely clamping the shelf mounting bracket to a column. It will be recognized that all of columns 12, 16 are of substantially the same construction and that a plurality of shelf mounting brackets are mounted to each column in the manner described. Each bracket is capable of supporting two shelf side frame members, one located on each side of a column. FIG. 3 shows the bottom end portions of shelf side frame members 32 received in shelf mounting hooks 50.

In the preferred arrangement, the length of long leg 76 on U-bolt E is at least two times as long as short leg 74. This provides adequate length for grasping between a person's thumb and fingers, while allowing easy insertion of the short leg through the slots and holes. In addition, the length of short leg 74 beyond connecting portion 80 thereof is not greater than two times the diameter of the rod from which U-bolt E is formed. This advantageous arrangement also provides adequate length for threading of a nut onto short leg 74 while providing easy passage thereof through the aligned slots and holes.

Although the invention has been shown and described with respect to a preferred arrangement, it is obvious that equivalent alterations and modifications will occur to others skilled in the art upon the reading and understanding of this specification. The present invention includes all such equivalent alterations and modifications, and is limited only by the scope of the claims.

I claim:

1. A shelf mounting bracket comprising: a generally flat rectangular plate having top and bottom edges and opposite side edges, flanges extending from said side edges substantially perpendicular to said plate, said flanges having shelf support hooks adjacent said plate bottom edge, said hooks having hook saddles with saddle axes extending generally perpendicular to said plate, said plate having a pair of elongated spaced-apart slots therein, said slots being spaced-apart and being elongated in a direction extending across said plate side edges, and said slots being located intermediate said plate top and bottom edges.

2. The bracket of claim 1 wherein said hooks are spaced above said plate bottom edge and said flanges have flange top ends spaced below said plate top edge.

3. A rack including the bracket of claim 1, further including a vertical column of rectangular cross-sectional configuration having a front face and opposite side faces, said front face having vertically-spaced pairs of holes therein, said holes in each of said pairs being spaced-apart in a direction extending across said side faces, said plate being positioned against said front face with said slots aligned with one of said pairs of said holes and with said flanges extending closely along said side faces, a generally U-shaped bolt having opposite parallel legs and a connecting portion extending between said legs, one of said legs being substantially longer than the other of said legs, said legs extending through one of said pairs of said holes and through said slots with said connecting portion positioned internally of said column, and nuts threaded on said legs against said plate.

4. The rack of claim 3 wherein one of said bracket legs is at least two times as long as the other of said legs.

5. The rack of claim 4 wherein the length of one of said bracket legs is not greater than two times the diameter of said bolt.

* * * * *